US006139064A

United States Patent [19]

Maier-Hunke

[11] Patent Number: 6,139,064

[45] Date of Patent: Oct. 31, 2000

[54] FOLDER FOR DOCUMENTS

[75] Inventor: Horst-Werner Maier-Hunke, Iserlohn, Germany

[73] Assignee: "Durable" Hunke & Jochheim GmbH & Co. KG, Iserlohn, Germany

[21] Appl. No.: 09/485,312

[22] PCT Filed: Aug. 19, 1998

[86] PCT No.: PCT/DE98/02504

§ 371 Date: Feb. 3, 2000

§ 102(e) Date: Feb. 3, 2000

[87] PCT Pub. No.: WO99/08883

PCT Pub. Date: Feb. 25, 1999

[51] Int. Cl.[7] ..... B42F 9/00

[52] U.S. Cl. ..... 281/45; 281/21.1; 281/28; 281/15.1; 281/38; 283/36

[58] Field of Search ..... 281/15.1, 21.1, 281/36, 37, 38, 45, 28, 23; 402/80 R, 8, 60; 283/36

[56] References Cited

U.S. PATENT DOCUMENTS

| | | | |
|---|---|---|---|
| 4,904,104 | 2/1990 | Gloeckle | 400/80 R |
| 5,226,676 | 7/1993 | Su | 281/45 |
| 5,285,952 | 2/1994 | Ho | 281/45 X |
| 5,765,873 | 6/1998 | Chen | 281/45 |
| 5,964,480 | 10/1999 | Chen | 281/15.1 |

FOREIGN PATENT DOCUMENTS

| | | |
|---|---|---|
| 0293709 | 12/1988 | European Pat. Off. . |
| 1255631 | 12/1967 | Germany . |

*Primary Examiner*—Willmon Fridie, Jr.
*Attorney, Agent, or Firm*—Mark P. Stone

[57] ABSTRACT

A folder designed as a clipboard file for non-perforated documents has one or more index sheets (14–18) retained in the back of the folder (3) by folding lines (24) which engage behind a clamp (5). Pressure is applied to a friction clamping spring (9) for moving the spring between closed and opened positions by applying pressure to a front leg (8) of the spring.

20 Claims, 1 Drawing Sheet

FOLDER FOR DOCUMENTS

TECHNICAL FIELD

The invention relates to a document binder having a clamping spring which has a rear and a front leg, can be displaced, transversely to the binder spine, from a document-release position into a document-clamping position and back, and the front leg of which grips through an opening in the binder spine onto a document-clamping strip so as to press the latter against the document in the clamping position.

PRIOR ART

A binder of the abovementioned type is disclosed in German Patent 1 255 631. Like other binders of clamping-spring design, which are disclosed, for example, in EP 0 293 709 B1, it is used for filing documents which do not have holes punched in them. While it has long been the custom, in the case of notebooks and binders for documents which do have holes punched in them, to use index sheets to subdivide filed stacks of documents, the possibility of doing the same in what could be called clamping binders has, until now, been lacking.

SUMMARY OF THE INVENTION

The invention is based on the object of providing a remedy for the deficiency resulting from the abovementioned lack of possibility. According to the invention, this object is achieved, in the case of a binder of the type under consideration, by virtue of the fact that it is provided with an index with a plurality of index sheets which have tabs, are equipped, on their edge facing the binder spine, with a punched-out portion, which comes to lie in the region of the opening for the clamping spring, and with folding strips which are adjacent to the punched-out portion and grip in a hook-like manner behind the clamping strip.

The invention has the advantage of expanding the range of use of the binders in question. The special design of the binder according to the invention ensures that the index sheets are joined to the binder in a long-lasting manner and that the index sheets fit securely in the binder.

Further details and features emerge from the subclaims and the description below of a particularly advantageous embodiment which is illustrated in the attached drawing.

WAYS OF IMPLEMENTING THE INVENTION

Figure 1:
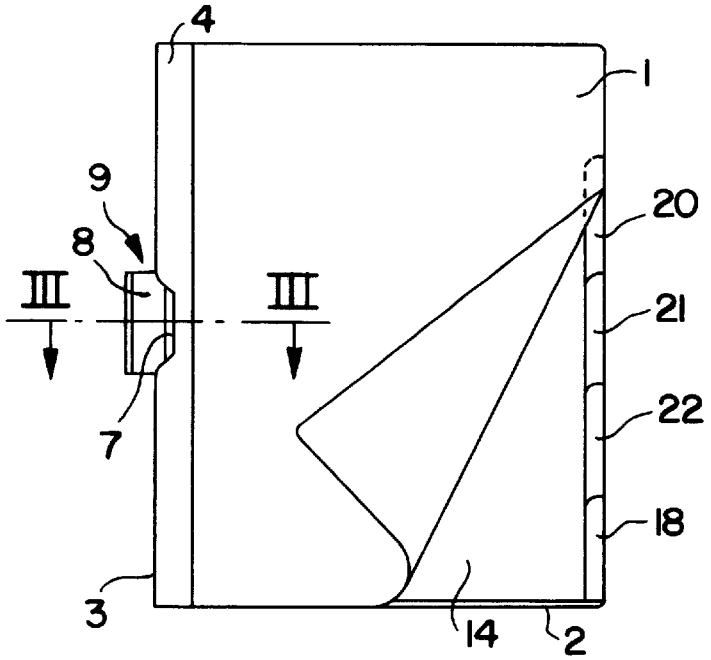
FIG. 1 shows the front view of a binder.

The binder illustrated in the figures has a front binder cover composed, for the most part, of a transparent plastic sheet 1, and a rear binder cover formed from part of a nontransparent plastic sheet 2. An edge section of the plastic sheet 2 is folded four times and forms the binder spine 3, a covering strip 4 and a clamping strip 5. The transparent plastic sheet 1 is joined to the clamping strip 5 via a weld 6. The front leg 8 of a clamping spring 9, which is preferably made of steel sheet, grips through an opening 7 extending from the binder spine 3 into the region of the covering strip 4, and the rear leg 10 of said clamping spring 9 bears against the rear side of the plastic sheet 2 forming the rear binder cover. The clamping spring 9 can be pushed to and fro, transversely to the binder spine 3, by amounts which are delimited by stops. The stops are formed in this case by a folding crease 11, which forms the transition between the covering strip 4 and the clamping strip 5, and a folding crease 12, the latter crease 12 being assigned a counter-stop comprising an edge strip 13, bent at an acute angle, of the front leg 8 of the clamping spring 9.

In order to make it possible to subdivide the document to be filed in the binder in a manner which takes specific organizational aspects into consideration, the binder is equipped with a plurality of index sheets 14, 15, 16, 17 and 18, of which the index sheets 14–17 have tabs 19, 20, 21 and 22, which are cut in one piece therewith.

Figure 2:
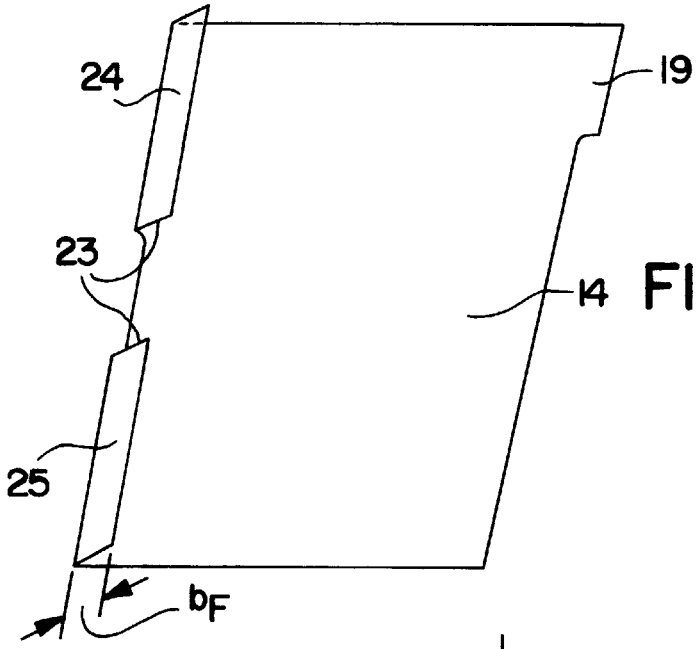
FIG. 2 shows the front view of an individual index sheet.
Figure 3:
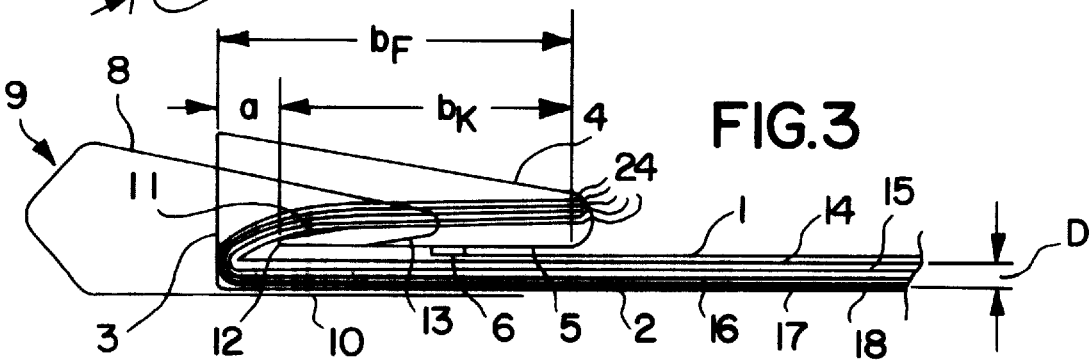
FIG. 3 shows, on an enlarged scale, a section along the line III—III in FIG. 1.

As can be seen best with reference to the index sheet 14 in FIG. 2, each of the index sheets is provided, on its edge facing the binder spine 3, with a U-shaped punched-out portion 23. Adjoining the punched-out portion 23, upwards and downwards, are folding strips 24 and 25 which, as can be seen in FIG. 3, grip in a hook-like manner behind the clamping strip 5. The illustrated manner of how the index sheets 14 to 18 are fixed ensures, on the one hand, that they are held securely and, on the other hand, creates adequate space for stacks of sheets of differing amounts to be placed between the individual index sheets. In this connection, it proves to be expedient if the distance A between the clamping strip 5 and the binder spine 3 is at least equal to twice the thickness D of the stack of index sheets, and if the width $b_F$ of the folding strip 24, 25, adjacent to the punched-out portion 23, of the index sheets 14 to 18 is essentially equal to the sum of the width $b_K$ of the clamping strip 5 and the abovementioned distance a.

What is claimed is:

1. Document binder having a clamping spring which has a rear and a front leg, can be displaced, transversely to the binder spine, from a document-release position into a document-clamping position and back, and the front leg of which grips through an opening in the binder spine onto a document-clamping strip so as to press the latter against the document in the clamping position, characterized in that it is provided with an index with a plurality of index sheets (14–18) which have tabs, are equipped, on their edge facing the binder spine (3), with a punched-out portion (23), which comes to lie in the region of the opening (7) for the clamping spring (9), and with folding strips (24, 25) which are adjacent to the punched-out portion and grip in a hook-like manner behind the clamping strip (5).

2. Binder according to claim 1, characterized in that some of the index sheets (14–17) are provided with tabs (19–22), which are cut in one piece therewith.

3. Binder according to claim 1, characterized in that the punched-out portion (23) of the index sheets (14–18) is of U-shaped design.

4. Binder according to claim 1, characterized in that the binder spine (3) and the clamping strip (5) are formed by part of a multiply folded edge section of a plastic sheet (2) which forms the rear binder cover.

5. Binder according to claim 1, characterized in that that edge of the clamping strip (5) which faces the binder spine (3) forms a stop, formed by a folding crease (12), for an edge strip (13), which is bent at an acute angle, of the front leg (8) of the clamping spring (9).

6. Binder according to claim 1, characterized in that the distance (a) between the clamping strip (5) and the binder spine (3) is at least equal to twice the thickness (D) of the stack of index sheets put into the binder.

7. Binder according to claim 1, characterized in that the width ($b_F$) of the folding strips (24, 25), adjacent to the punched-out portion (23), of the index sheets (14–18) is essentially equal to the sum of the width ($b_K$) of the clamping strip (5) and the distance (a) thereof from the binder spine (3).

8. Binder according to claim 2, characterized in that the punched-out portion (23) of the index sheets (14–18) is of U-shaped design.

9. Binder according to claim 2, characterized in that the binder spine (3) and the clamping strip (5) are formed by part of a multiply folded edged section of a plastic sheet (2) which forms the rear binder cover.

10. Binder according to claim 3, characterized in that the binder spine (3) and the clamping strip (5) are formed by part of a multiply folded edged section of a plastic sheet (2) which forms the rear binder cover.

11. Binder according to claim 2, characterized in that the edge of the clamping strip (5) which faces the binder spine (3) forms a stop, formed by a folding crease (12), for an edge strip (13), which is bent at an acute angle, of the front leg (8) of the clamping spring (9).

12. Binder according to claim 3, characterized in that the edge of the clamping strip (5) which faces the binder spine (3) forms a stop, formed by a folding crease (12), for an edge strip (13), which is bent at an acute angle, of the front leg (8) of the clamping spring (9).

13. Binder according to claim 4, characterized in that the edge of the clamping strip (5) which faces the binder spine (3) forms a stop, formed by a folding crease (12), for an edge strip (13), which is bent at an acute angle, of the front leg (8) of the clamping spring (9).

14. Binder according to claim 2, characterized in that the distance (a) between the clamping strip (5) and the binder spine (3) is at least equal to twice the thickness (D) of the stack of index sheets put into the binder.

15. Binder according to claim 3, characterized in that the distance (a) between the clamping strip (5) and the binder spine (3) is at least equal to twice the thickness (D) of the stack of index sheets put into the binder.

16. Binder according to claim 4, characterized in that the distance (a) between the clamping strip (5) and the binder spine (3) is at least equal to twice the thickness (D) of the stack of index sheets put into the binder.

17. Binder according to claim 5, characterized in that the distance (a) between the clamping strip (5) and the binder spine (3) is at least equal to twice the thickness (D) of the stack of index sheets put into the binder.

18. Binder according to claim 2, characterized in that the width ($b_F$) of the folding strips (24, 25), adjacent to the punched-out portion (23), of the index sheets (14–18) is essentially equal to the sum of the width ($b_k$) of the clamping strip (5) from the distance (a) thereof from the binder spine (3).

19. Binder according to claim 3, characterized in that the width ($b_F$) of the folding strips (24, 25), adjacent to the punched-out portion (23), of the index sheets (14–18) is essentially equal to the sum of the width ($b_k$) of the clamping strip (5) from the distance (a) thereof from the binder spine (3).

20. Binder according to claim 4, characterized in that the width ($b_F$) of the folding strips (24, 25), adjacent to the punched-out portion (23), of the index sheets (14–18) is essentially equal to the sum of the width ($b_k$) of the clamping strip (5) from the distance (a) thereof from the binder spine (3).

* * * * *